US005342070A

United States Patent [19]

Miller et al.

[11] Patent Number: 5,342,070

[45] Date of Patent: Aug. 30, 1994

[54] IN-LINE SKATE WITH MOLDED JOE BOX

[75] Inventors: Douglas R. Miller, Eden Prairie; Timothy J. Wiener, Minnetonka, both of Minn.; Gregory J. Collins, Toronto, Canada

[73] Assignee: Rollerblade, Inc., Minnetonka, Minn.

[21] Appl. No.: 13,567

[22] Filed: Feb. 4, 1993

[51] Int. Cl.[5] ..... A63C 17/06

[52] U.S. Cl. ..... 280/11.22; 36/3 A; 36/115

[58] Field of Search ..... 280/7.13, 11.12, 11.19, 280/11.22, 11.23, 841; 36/3 A, 45, 47, 77 M, 87, 115, 131

[56] References Cited

U.S. PATENT DOCUMENTS

| | | | |
|---|---|---|---|
| 2,095,942 | 10/1937 | Welterstrand | 280/841 X |
| 2,452,502 | 10/1948 | Tarbox | 36/87 |
| 4,351,537 | 9/1982 | Seidel | 280/11.12 |
| 4,509,276 | 4/1985 | Bourque | 36/115 |
| 4,693,021 | 9/1987 | Mazzarolo | 36/3 A X |
| 4,835,885 | 6/1989 | Hoshizaki et al. | 36/115 |
| 5,171,033 | 12/1992 | Olson et al. | 36/115 X |
| 5,210,963 | 5/1993 | Harwood | 36/77 M X |

FOREIGN PATENT DOCUMENTS

| | | | |
|---|---|---|---|
| 2570256 | 3/1986 | France | 36/77 M |
| 571048 | 8/1945 | United Kingdom | 280/11.22 |

*Primary Examiner*—Brian L. Johnson

*Attorney, Agent, or Firm*—Merchant, Gould, Smith, Edell, Welter & Schmidt

[57] ABSTRACT

An in-line skate includes a boot having an upper secured to a sole. The boot has a molded toe box secured to the sole. Walls of the toe box define a cavity sized to receive the toes of a skater's foot. The boot further includes a sewn portion stitched to the edges of the toe box.

5 Claims, 13 Drawing Sheets

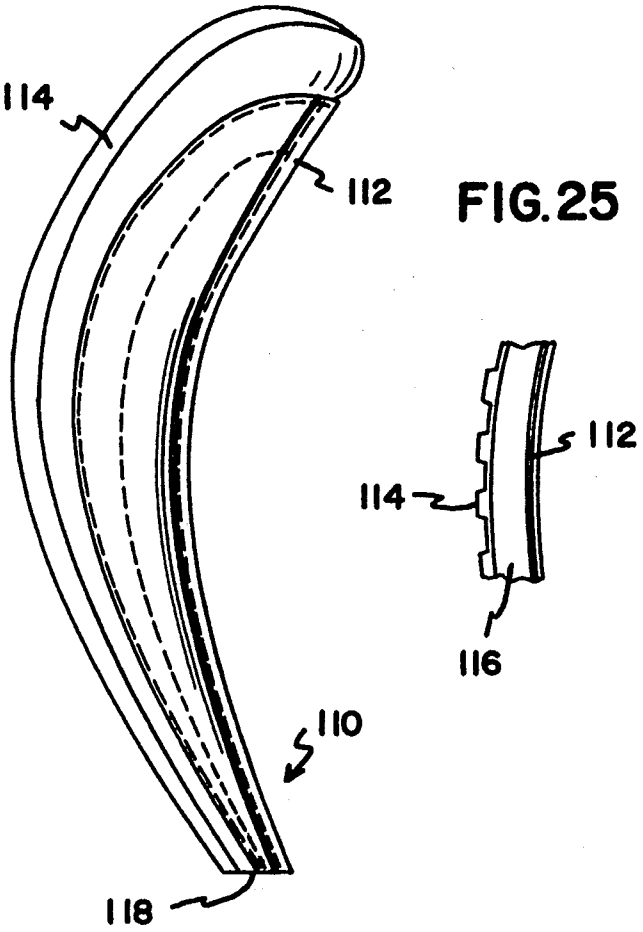
FIG. 25
FIG. 24
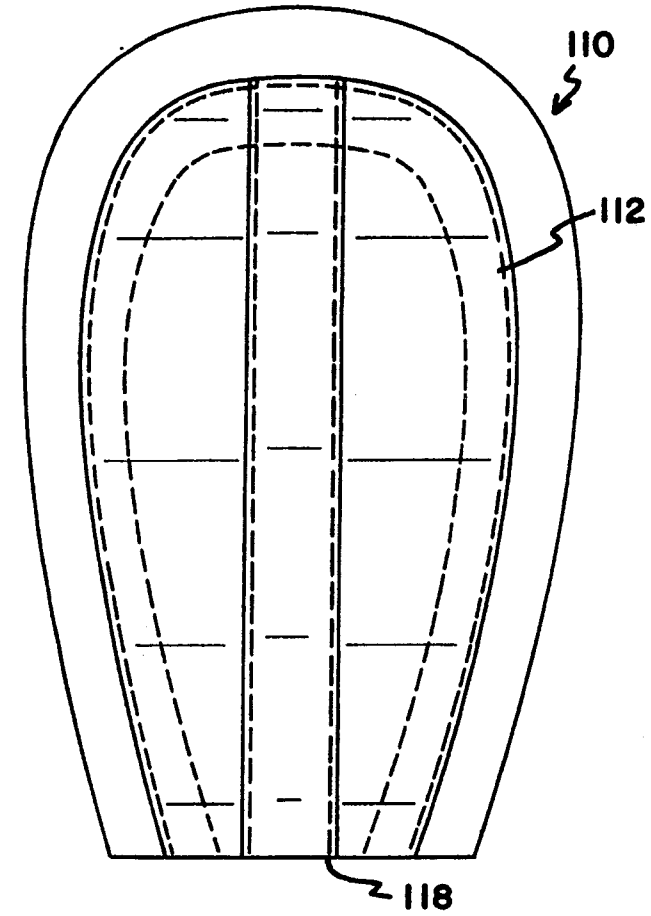
FIG. 23

IN-LINE SKATE WITH MOLDED JOE BOX

BACKGROUND OF THE INVENTION

1. Field of the Invention

This invention pertains to an in-line skate. More particularly, this invention pertains to a novel construction of boot for such a skate.

2. Description of the Prior Art

In the prior art, in-line skates (skates with linearly aligned rollers) have become very popular in recent years (see, e.g., U.S. Pat. No. 5,171,033. Enthusiasts use such skates for exercise as well as participating in team sports. An example of such a team sport using in-line skates is hockey played on pavement or other hard surface rather than played on ice with traditional bladed hockey skates.

Hockey enthusiasts who wish to partake in an in-line skating version of hockey commonly desire that the in-line skate have an appearance which conforms with conventional bladed hockey skates. As a result, such enthusiasts desire an in-line skate with a sewn boot (preferably having a leather boot upper) as opposed to the molded boot which is common in in-line skates.

While sewn boots can be readily made, they have an inherent disadvantage for use in in-line skating. Namely, the surface on which in-line hockey skating is performed is rough and abrasive compared to ice. As a result, a sewn leather boot will deteriorate faster on an abrasive surface when used in in-line skating.

It is an object of the present invention to provide an in-line skate with a sewn boot which can give an appearance of a hockey skate while at the same time accommodating high abrasion common during in-line skating.

SUMMARY OF THE INVENTION

According to a preferred embodiment of the present invention, an in-line skate is provided having a boot for receiving a skater's foot. A frame is secured to the sole of the boot with the frame carrying a plurality of linearly aligned rollers. The boot includes an upper which is secured to the sole. The upper has a molded toe box secured to the sole at a toe end. The toe box has a forward wall, a top wall and side walls defining a toe box cavity. The cavity is sized to receive the toes of the skater's foot. The side walls terminate at left and right side wall edges. The top wall terminates at a top wall edge. The boot further includes a sewn portion having a heel and right side wall and left side wall having a bottom perimeter. The left and right side walls of the sewn portion are secured to the left and right side edges, respectively, and the bottom perimeter is secured to the sole.

BRIEF DESCRIPTION OF THE DRAWINGS

FIG. 23 is a plan view of a tongue;

FIG. 24 is a side elevation view of the tongue of FIG. 23;

FIG. 25 is a cross sectional view showing the construction of the tongue of FIG. 23;

DESCRIPTION OF THE PREFERRED EMBODIMENT

Figure 1:
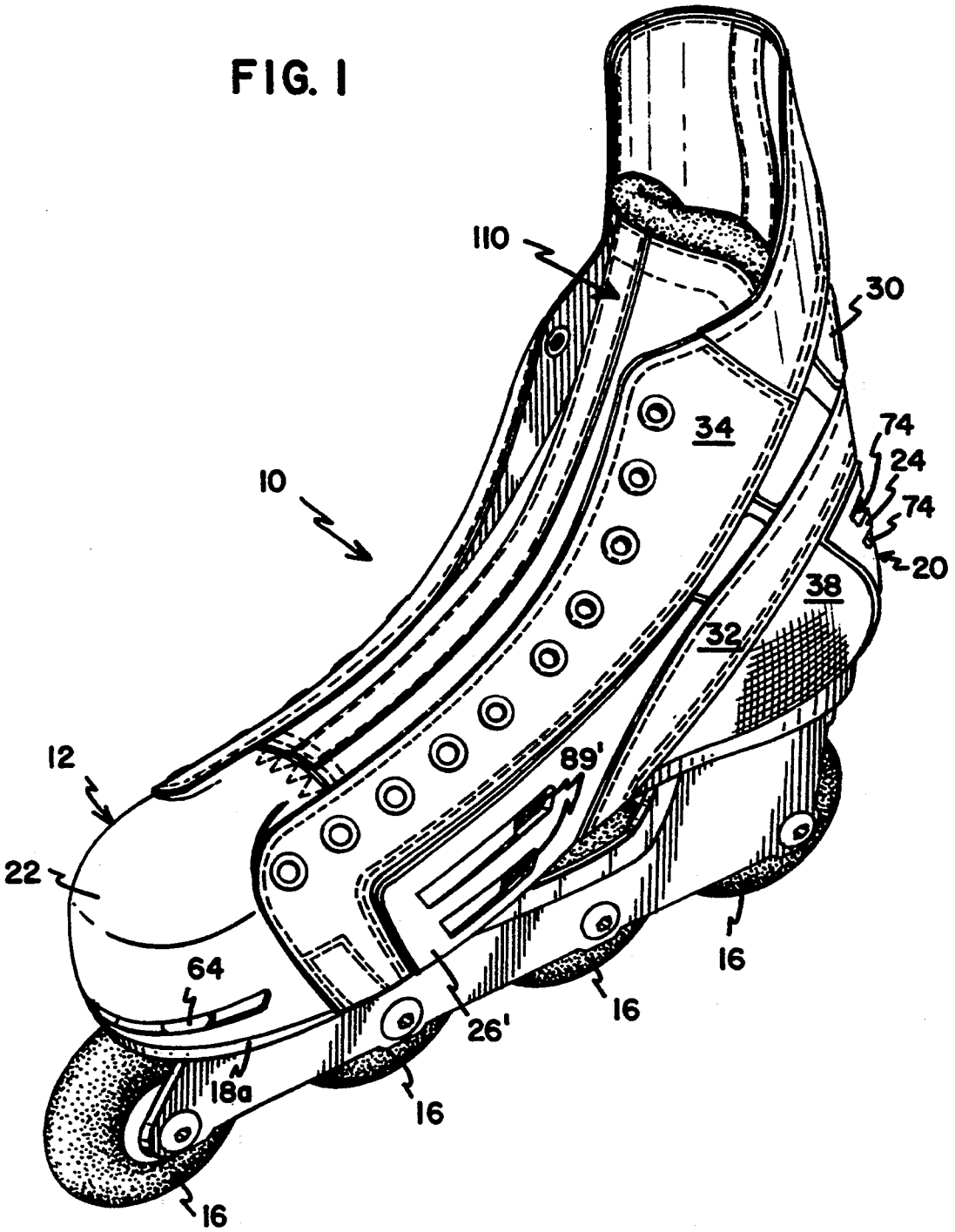
FIG. 1 is a left side, front and top perspective view of an in-line skate according to the present invention.
Figure 2:
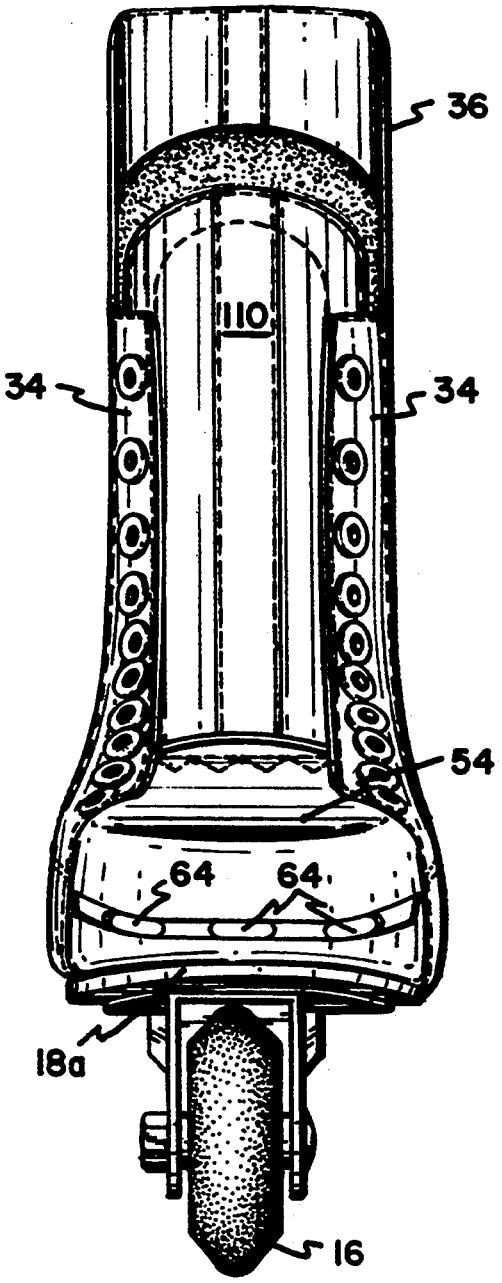
FIG. 2 is a front elevation view of the skate of FIG. 1.
Figure 3:
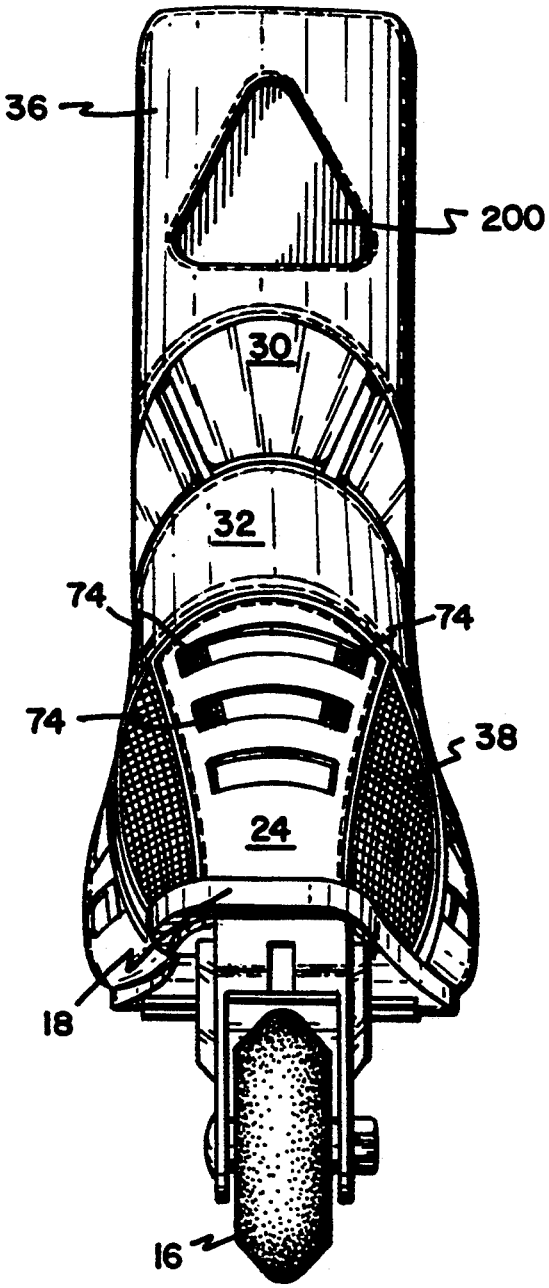
FIG. 3 is a back elevation view of the skate of FIG. 1.
Figure 4:
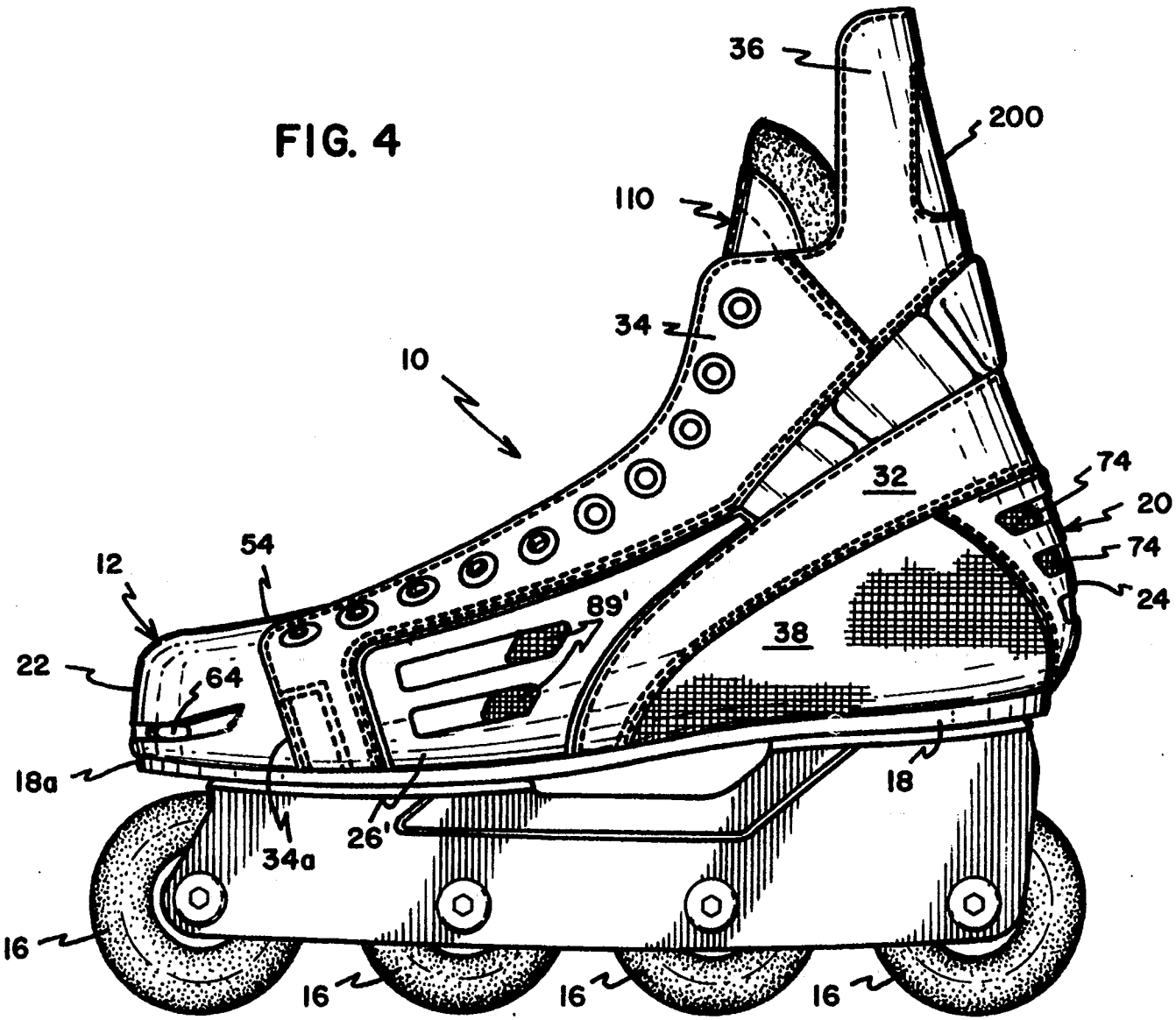
FIG. 4 is a side elevation view of the left side of the skate of FIG. 1.
Figure 5:
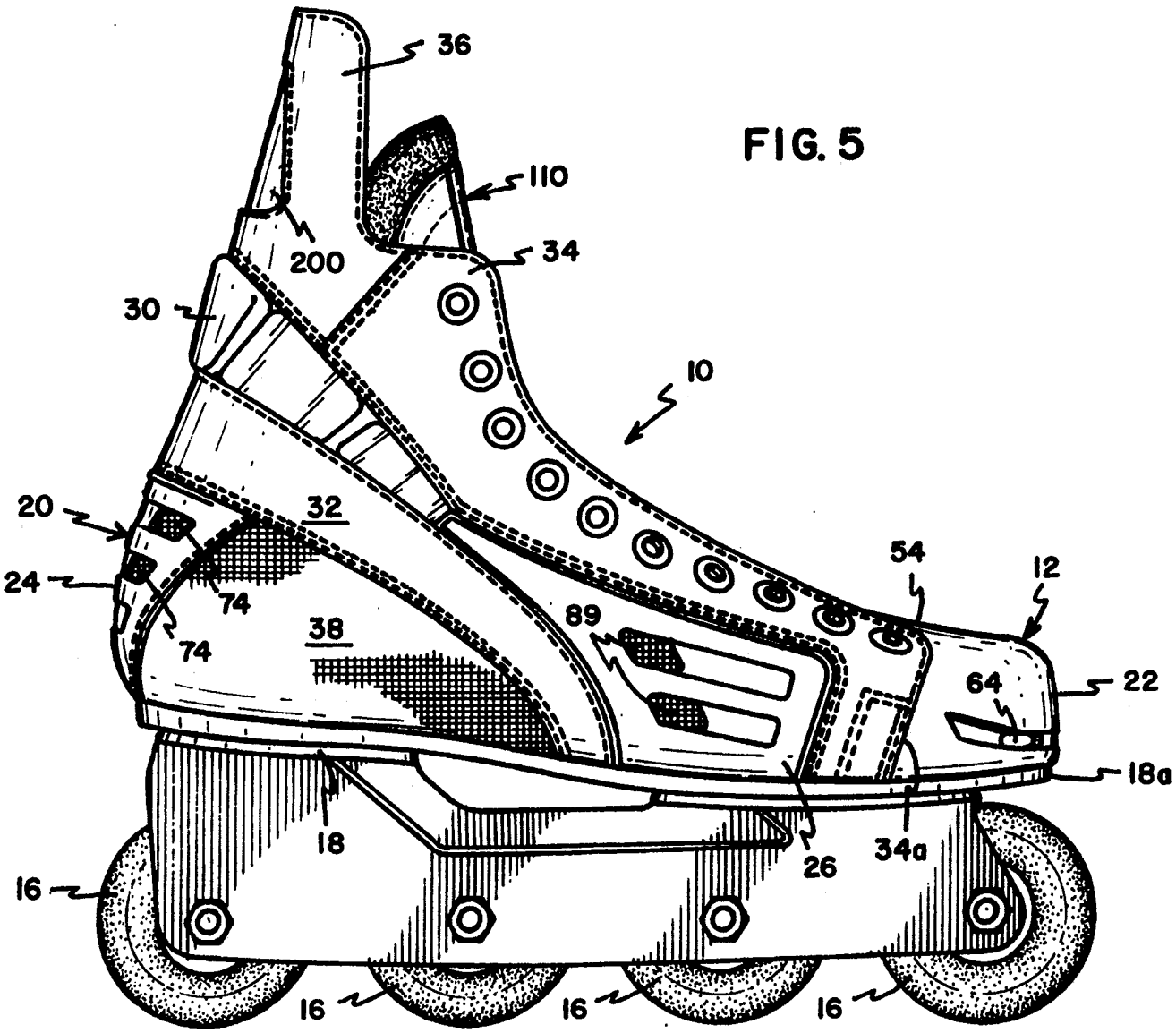
FIG. 5 is a right side elevation view of the skate of FIG. 1.
Figure 6:
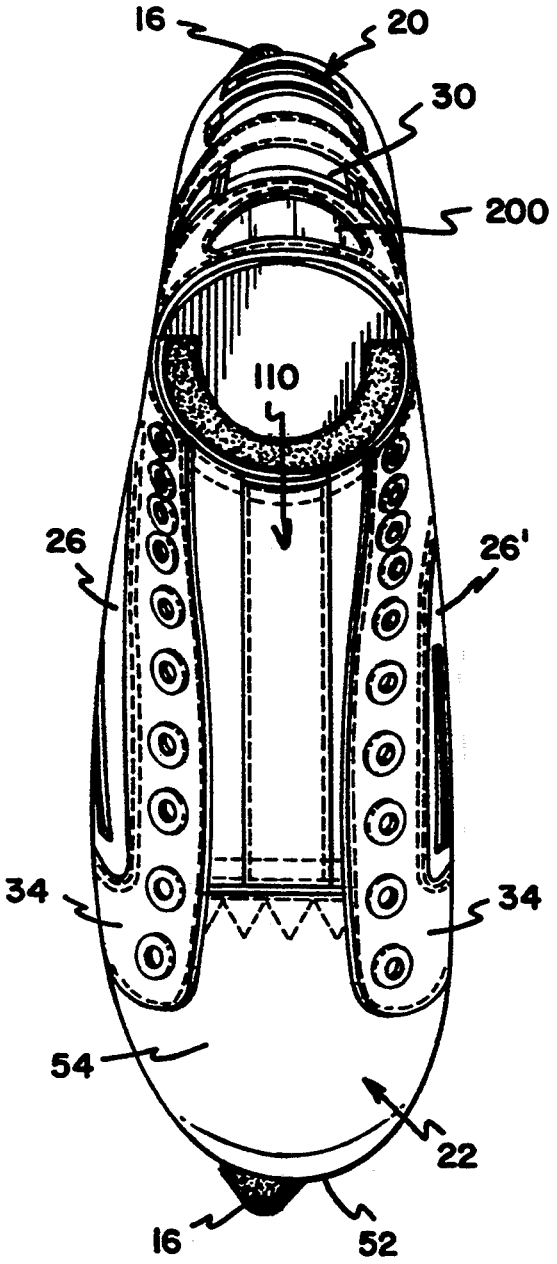
FIG. 6 is a top plan view of the skate of FIG. 1.
Figure 7:
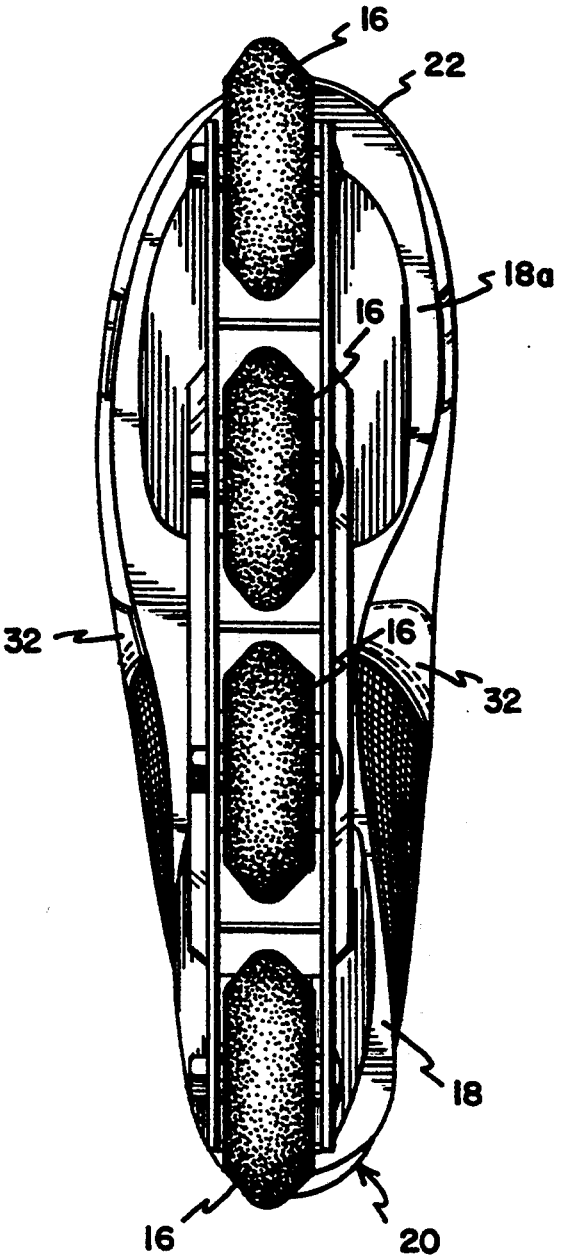
FIG. 7 is a bottom plan view of the skate of FIG. 1.

Referring now to the several drawing figures in which identical elements are numbered identically throughout, a description of the preferred embodiment of the present invention will now be provided.

In the drawings, an in-line skate is shown generally at 10. The skate includes a boot 12 and a frame 14. The frame 14 carries a plurality of linearly aligned rollers 16.

The boot 12 comprises a sole 18 and an upper 20. The frame 14 is secured to the sole 18.

The boot upper 20 includes a toe box 22, a heel pad 24, a right side panel 26, a left side panel 26' and a decorative ankle pad 30. As will be more fully described, the toe box 22, heel pad 24, side panels 26, 26' and ankle pad 30 are all formed of abrasion-resistant, injection-molded plastic such as polyethylene or polypropylene.

The boot upper 20 further includes a plurality of decorative facings including a wrap-around side facing 32, an eye stay 34, a tendon guard 36 and an instep 38. For giving an appearance of a traditional hockey skate, facing 32, stay 34 and guard 36 are preferably leather. Instep 38 may be leather, but, for aesthetics, nylon is used in a preferred embodiment.

Figure 10:
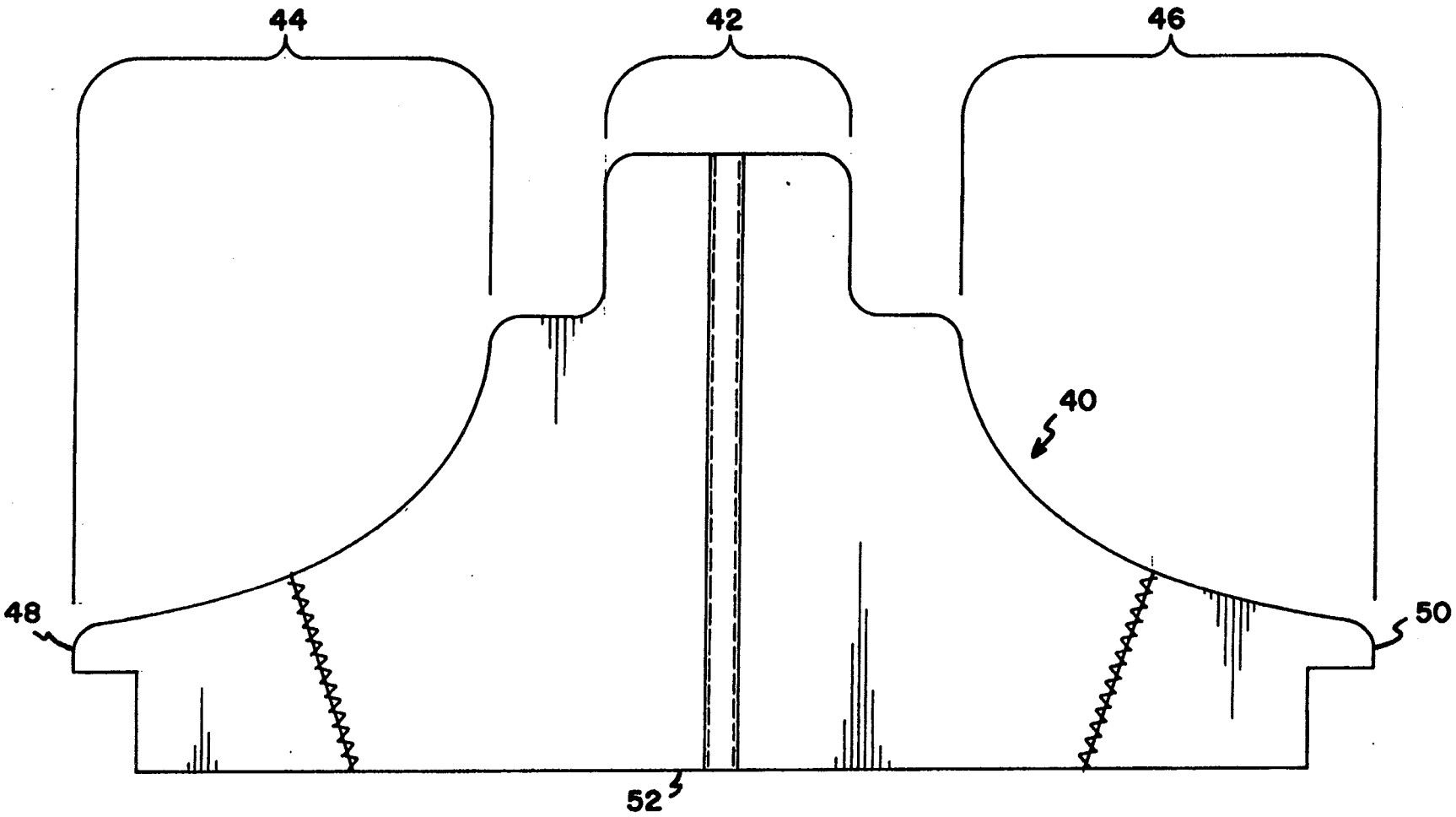
FIG. 10 is a plan view of a liner for use with the skate.
Figure 11:
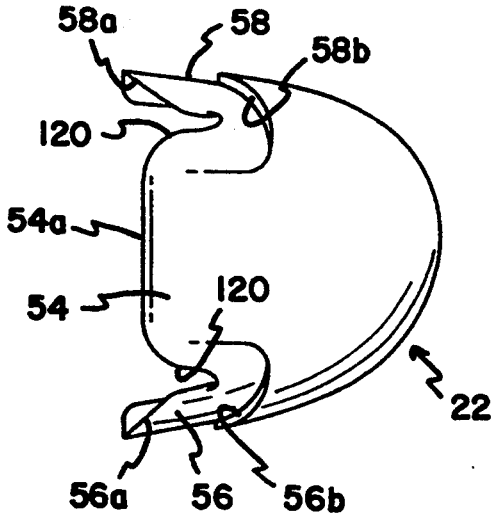
FIG. 11 is a top plan view of a toe box.
Figure 12:
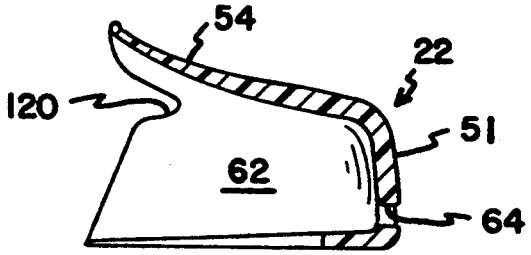
FIG. 12 is a side sectional view of the toe box of FIG. 11.
Figure 13:
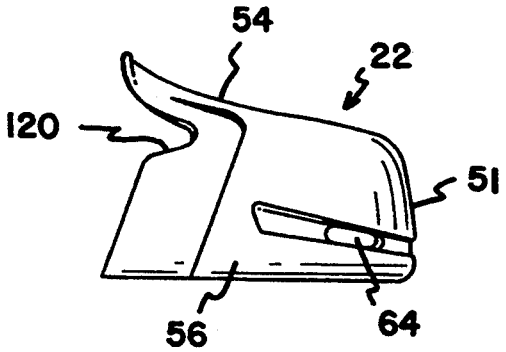
FIG. 13 is the side elevation view of the toe box of FIG. 11.
Figure 14:
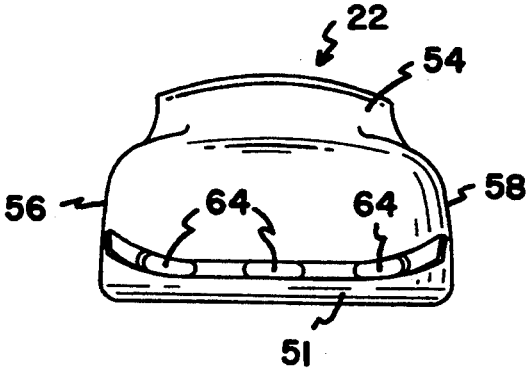
FIG. 14 is a front elevation view of the toe box of FIG. 11.

The skate further includes an interior lining 40. Shown best in FIG. 10, the lining 40 is shown flat and includes a heel portion 42, a right side portion 44 and a left side portion 46. The side portions 44, 46 terminate at right and left side edges, respectively, 48, 50. The lining terminates at a bottom edge 52. Lining 40 is conventional and, preferably, is a multi-ply construction including a synthetic layer for stiffening and a leather layer directly opposing the user's foot.

With best reference to FIGS. 9, 11–14 and 14A, the toe box 22 is shown. Toe box 22 includes a front wall 52, a top wall 54 and right and left side walls 56, 58. The top wall 54 terminates at a free edge 54*a*. Side walls 56, 58 terminate at free edges 56*a*, 58*a*. The side walls 56, 58 also include raised ridges 56*b*, 58*b*, the function of which will be described.

Figure 14A:
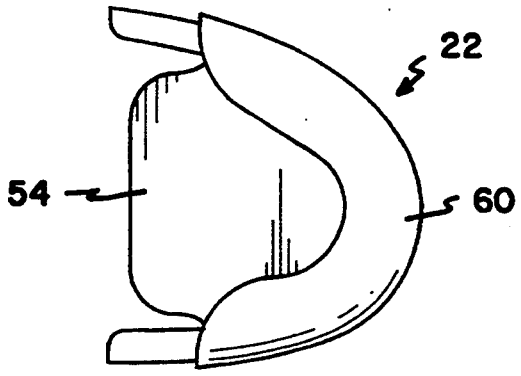
FIG. 14A is a bottom plan view of a toe box.

A bottom edge of the side walls 56, 58 and front wall 51 is provided with an inwardly projecting bottom flange 60 (FIG. 14A). The side walls 56, 58 and top wall 54 cooperate to define a toe box cavity 62 (FIG. 12) sized to receive the toes of a user's foot. The box 22 is secured to the toe end 18*a* of the sole 18 by securing the bottom flange 60 to a top surface of the sole 18 through any suitable means (such as adhesives).

The forward wall 51 is provided with a plurality of vent slots 64 formed therethrough.

Figure 15:
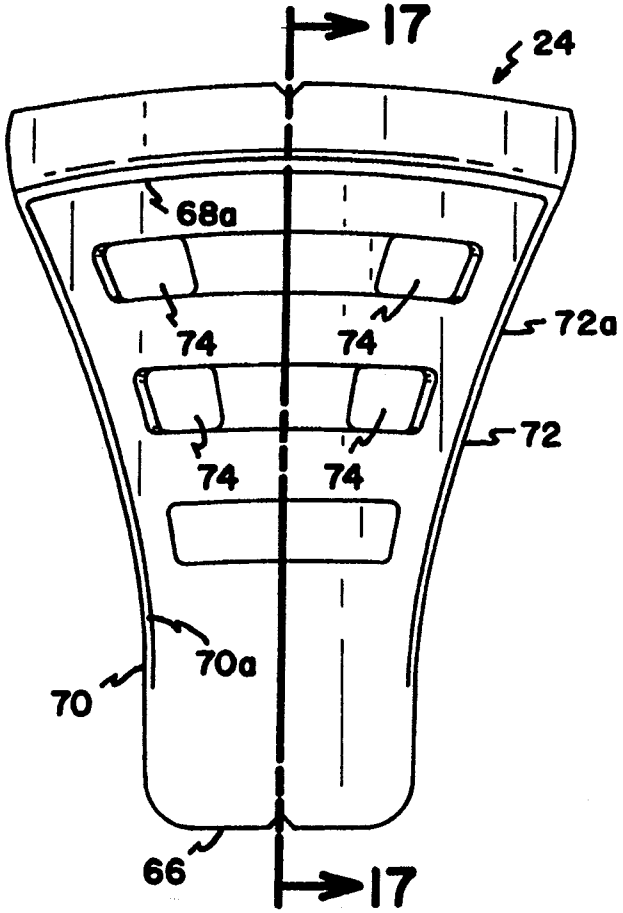
FIG. 15 is a plan view of an ankle pad.
Figure 16:
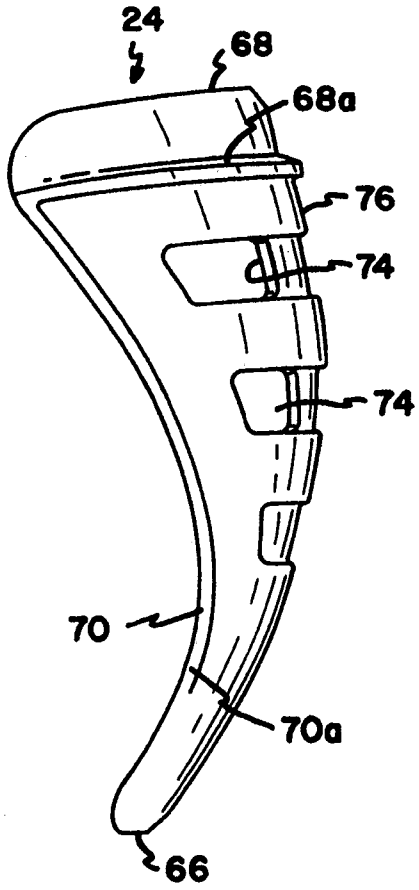
FIG. 16 is a side elevation view of the ankle pad of FIG. 15.
Figure 17:
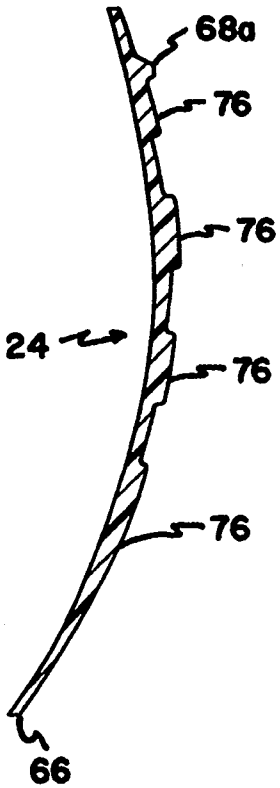
FIG. 17 is a view taken along lines 17—17 of FIG. 15.

Referring now to FIGS. 15–17, the heel pad 24 is shown. The heel pad 24 is an arcuate pad arching both in its longitudinal and transverse dimensions to encompass and surround the heel of a user. The pad 24 extends from a bottom edge 66 to a top edge 68 and from a left side edge 70 to a right side edge 72. At side edges 70, 72, raised ribs 70*a*, 72*a* are provided. Further, a rib 68*a* is provided near top edge 68. A plurality of vent holes 74 are formed through the pad 24. Also, the pad 24 has a plurality of raised areas 76 (shown best in FIG. 17).

Figure 18:
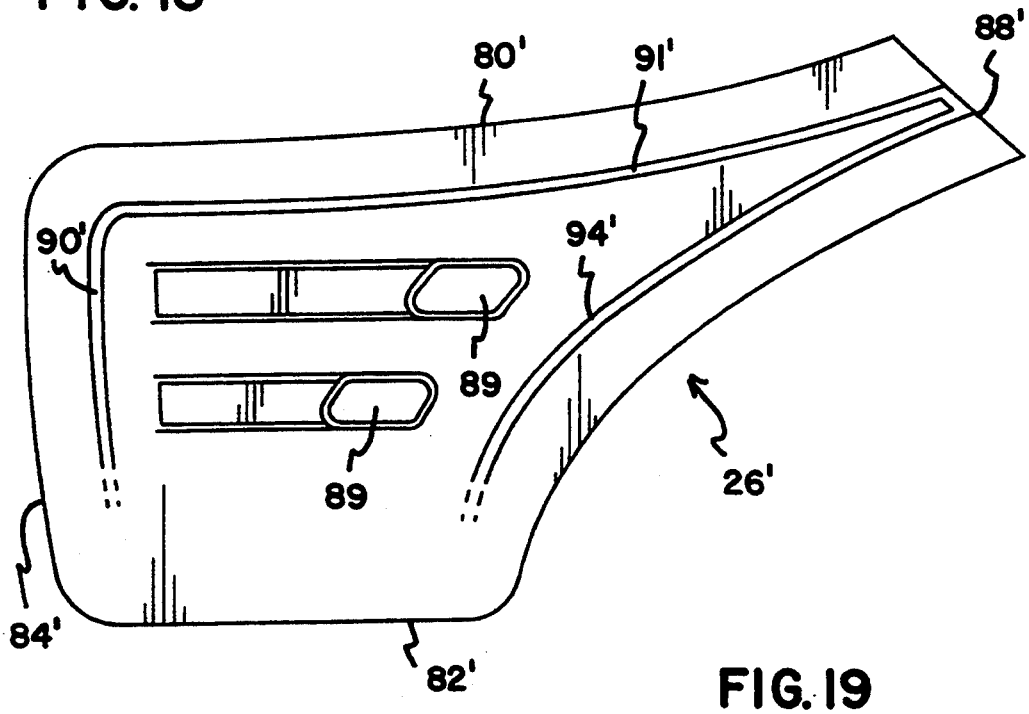
FIG. 18 is a plan view of a left side panel.
Figure 19:
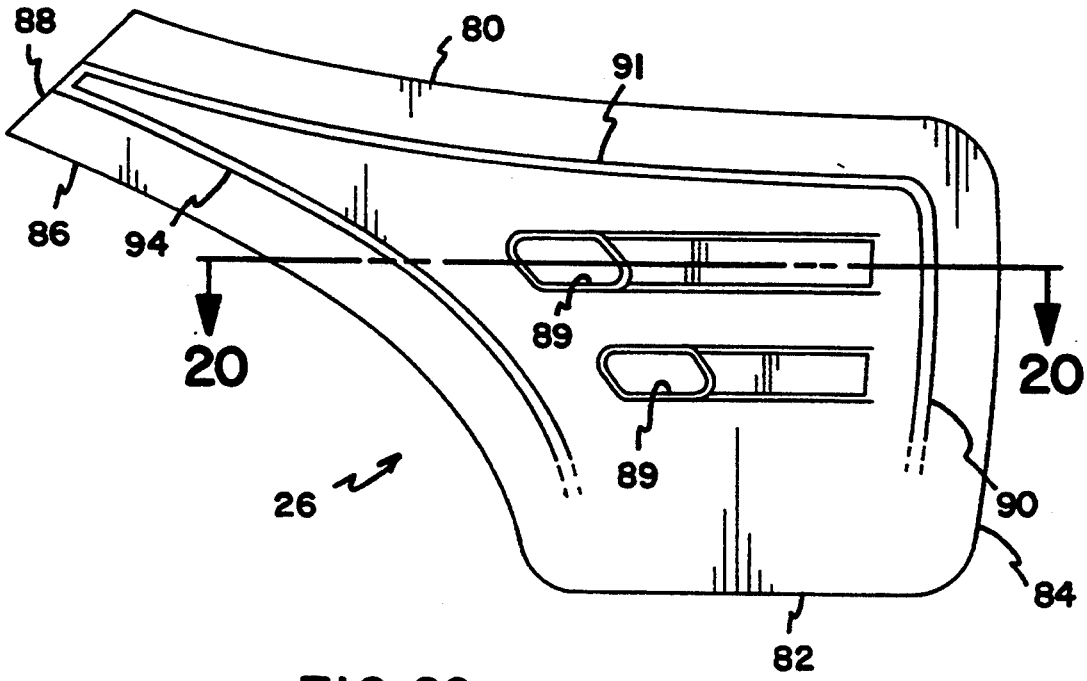
FIG. 19 is a plan view of a right side panel.
Figure 20:
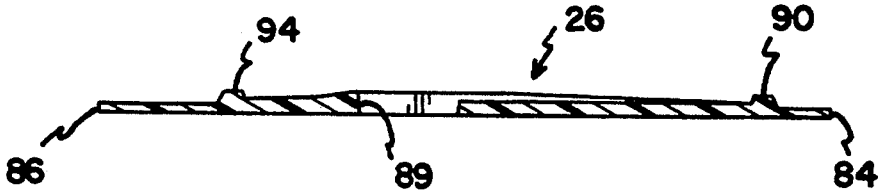
FIG. 20 is a view taken along lines 20—20 of FIG. 19.

Referring now to FIGS. 18 through 20, the right side panel 26' and left side panel 26' are shown. Each of the panels is identical (being only a mirror image of the other) and a description of panel 26' will suffice as a description of panel 26' (in the figures, elements of panel 26' are numbered identically to corresponding elements of panel 26 with the addition of an apostrophe). Also, left and right side construction is symmetrical. A description of the right side construction will suffice as a description of the left side.

Panel 26 includes a top edge 80 and a spaced apart bottom edge 82. The panel 26 has a forward edge 84 connecting top and bottom edges 80, 82. Extending arcuately upward and rearward from bottom edge 82 is an angled edge 86 which is connected to the top edge 80 by a rear edge 88.

A raised rib 90 is provided generally parallel to and spaced from edge 84. Similarly, a raised rib 91 is provided generally parallel to and spaced from edge 80. Also, a raised rib 94 is provided generally parallel and spaced from edge 86. Vent holes 89 are formed through the side panel.

Figure 21:
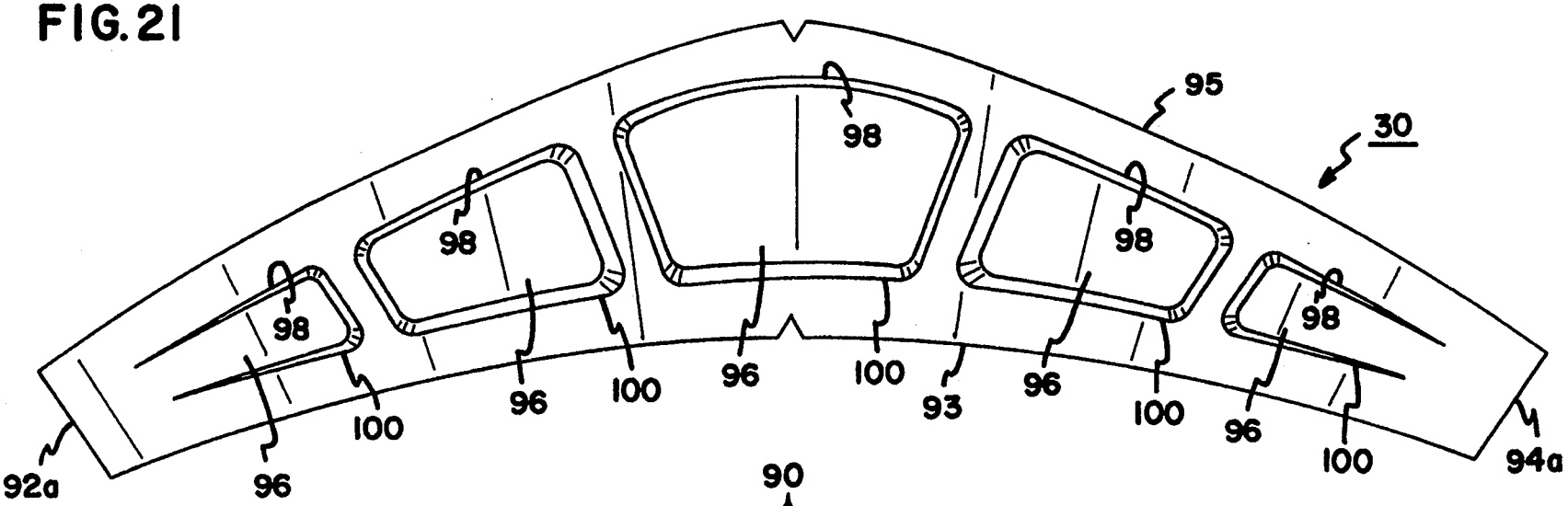
FIG. 21 is a plan view of an ankle pad.
Figure 22:
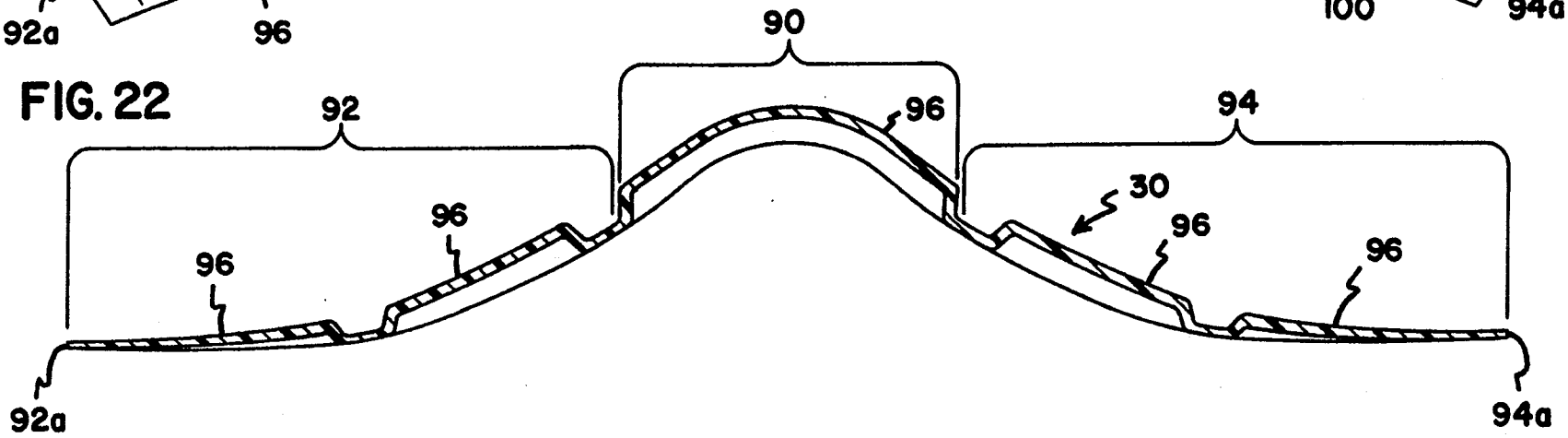
FIG. 22 is a side sectional view of the ankle pad of FIG. 21.

Referring now to FIGS. 21–22, an ankle pad 30 (provided for aesthetics) is shown. The pad 30 is shown extended outwardly (rather than in a normal arcuate shape to conform with the ankle of a user) and includes a heel portion 96, a left side portion 92 and a right side portion 94. The pad 30 terminates at left and right side edges 92*a*, 94*a* as well as top edge 95 and bottom edge 93. A plurality of raised surfaces 96 are formed on the ankle pad 30. The raised surfaces 96 present top and bottom raised ridges 98, 100 which are spaced from and generally parallel to edges 95, 93, respectively.

In construction of the boot, the toe box 22 is secured to the sole 18. The remaining molded components including the heel pad 24, right side panel 26, left side panel 28 and ankle pad 30, together with the facings 32, 34, 36, 38, are secured to the interior lining 40 by stitching.

In securing the side facing 32 and the panels 26, 26', ankle pad 30 and heel 24 to the interior lining 40, the raised ridges 94, 94', 68*a* and 100 act as locator ridges for placing the side facing 32 against the panels 26, 26', ankle pad 30 and heel 24. These elements are then stitched together and stitched to the interior lining 40.

Figure 8:
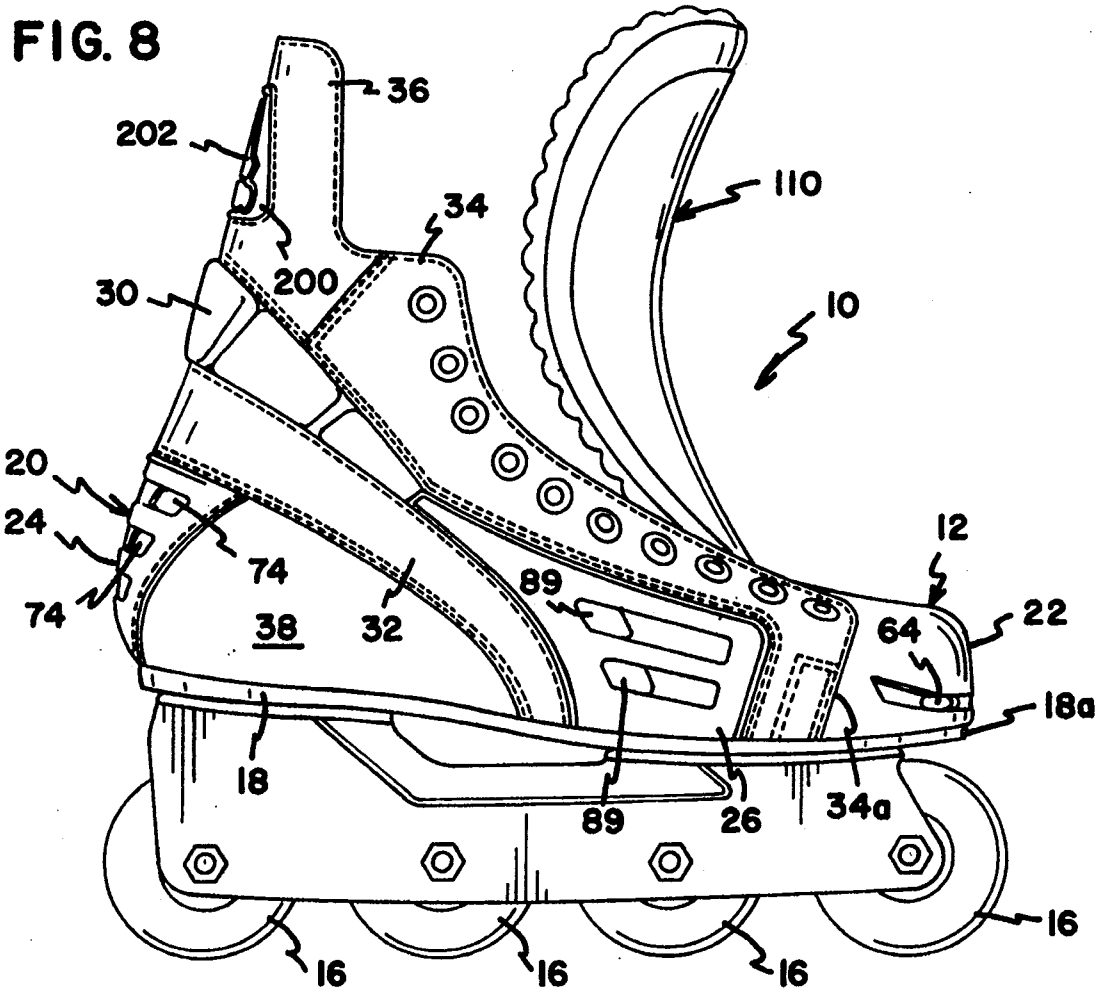
FIG. 8 is a side elevation view of the skate of FIG. 1 showing a tongue partially removed from the skate.

Similarly, the eye stay 34 is secured to the ankle pad 30 and side panels 26, 26' by placing the eye stay 34 against locator ribs 98, 91, 91' and 90. The side edges 48, 50 of the lining 40, together with the forward edges 34*a* (FIG. 8) of the eye stay 34, are stitched together as well as stitched onto the toe box 22. The reader will note that the raised ridges 56*b*, 58*b* of the toe box 22 act as a locator for accurately locating the placement of edges 34*a* and 48, 50. The tendon guard 36 is also stitched to the lining 40 using ridge 98 as a locator surface. In the figures, the tendon guard 36 has a cut-out 200 into which a pad 202 may be stitched to act as a product logo.

Note the side facing 32 is secured to the heel pad 24 using surface 68 as a locating surface. Ribs 70, 72 act as locating surfaces to locate a stitch to secure the side edges of the heel pad to the instep 38.

As a result of the foregoing construction, the interior lining 40 acts as the main boot form with the exterior elements stitched to one another and to the liner 40.

Figure 9:
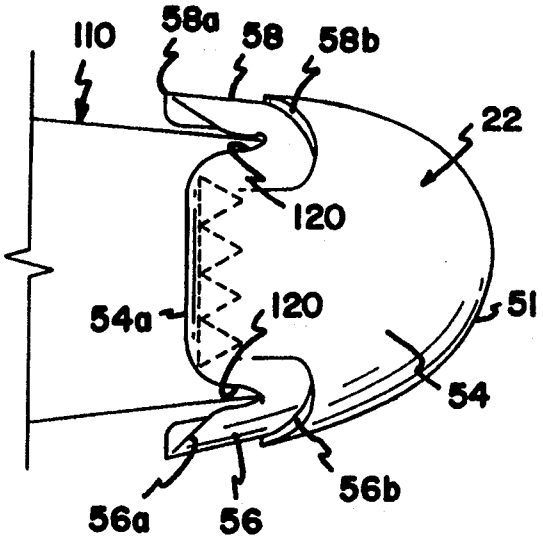
FIG. 9 is a top plan view showing attachment of the tongue to a toe box.

A tongue 110 (FIGS. 23–25) is provided consisting of multiple layers of material including an outer leather layer 112, an inner fabric 114 and (sandwiched therebetween) a foam pad 116. The tongue terminates at a bottom edge 118 which is stitched to the edge 54*a* of toe box 22 (FIG. 9).

With the construction thus described, a boot is provided with a plurality of sewn leather or fabric exterior elements to give a pleasing appearance resembling a conventional hockey skate. However, molded panels including toe box 22, side panels 26, 26' and heel pad 20 are provided which are abrasive resistant to add durability and wear to the skate. Also, the toe box 22 has vents 64 which provide added comfort to the user. The vents 74 and 89 of the heel pad 24 and side panels 26, 26' are not functional unless, after construction, the interior lining 40 (or fabric of instep 38) covering the vents is removed. Such removal is optional.

In addition to providing increased wearability of the product while permitting a sewn hockey boot appearance, the present invention is readily adaptable to numerous sizes of boots.

Figure 26:
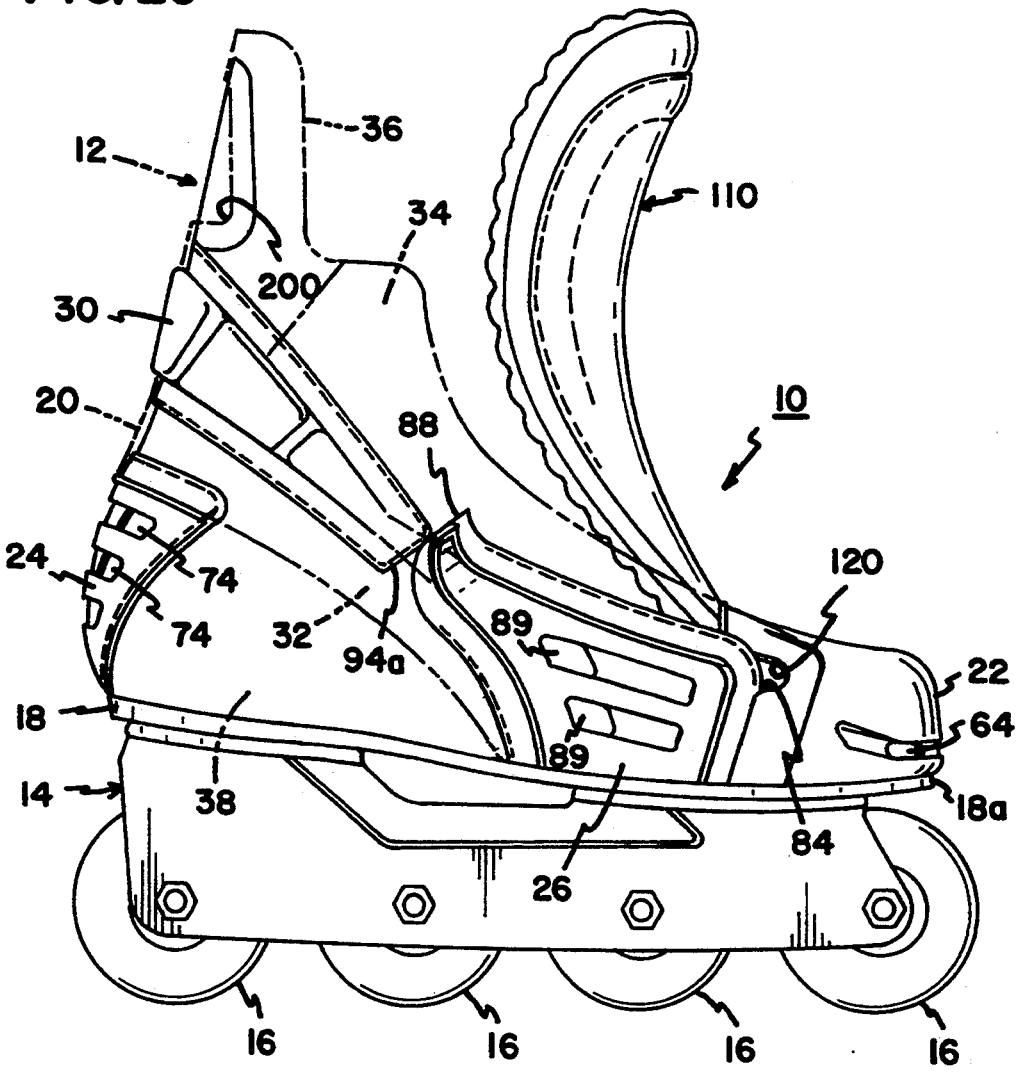
FIG. 26 is a view similar to that of FIG. 8 showing non-molded components (except for the tongue) in phantom lines and with edges of certain molded components shown pulled back to reveal a method of construction.

With best reference to FIG. 26, the toe box 22 is provided with cutouts 120 sized to receive the forward edges 84, 84' of the side panels 26, 26' in overlapping, sliding engagement. Similarly, the rear edges 88 overlie the edges 94*a*, 92*a* of the ankle pad. (In FIG. 26, edge 88 is shown bent back to expose edge 94*a*). As a consequence, for larger size or smaller size boots, the molded elements can move relative to one another before stitching to the liner 40. Accordingly, for purposes of component part inventory control, only a single size of the molded components is required. Instead, when different sized boots are required, the leather elements are simply die cut, or otherwise formed, and placed onto the interior lining 40. The correct positioning of the one-size-fits-all molded components is attained by simply sliding the molded components relative to one another until a desired position is attained. When the position is attained, the final lasting and stitching of the boot is made. Accordingly, high cost associated with numerous molds for making different sized molded elements and inventorying different components of different sized molded elements is avoided.

From the foregoing detailed description of the present invention, it has been shown how the objects of the invention have been attained in a preferred manner. However, modifications and equivalents of the disclosed concepts, such as those which readily occur to one skilled in the art, are intended to be included within the scope of the claims.

What is claimed is:

1. An in-line skate comprising:

a boot for receiving skater's foot, said boot including a sole;

a frame secured to said sole, said frame carrying a plurality of linearly aligned rollers;

said boot further including a boot upper secured to said sole, said upper having:

a rigid, abrasive resistant molded toe box secured to said sole at a toe end thereof, said toe box having walls including a forward wall, a top wall and side walls defining a toe box cavity sized to receive the toes of said skater's foot, said side walls and top walls terminating at a left wall edge having a first outer recess area, a right wall edge having a second outer recess area and a top wall edge;

said boot including a flexible, sewn portion including a heel, a right side wall and a left side wall with said heel and right and left side walls having a common bottom perimeter, said right and left side walls of said sewn portion secured to said right and left wall edges with said right and left side walls received within said second and first recessed areas, respectively, and said bottom perimeter secured to said sole.

2. An in-line skate according to claim 1 comprising a tongue sized to extend between said side walls of said sewn portion and having an attachment end secured to said top wall edge.

3. An in-line skate according to claim 1 comprising left and right side wall molded side panels secured to said left and right side walls, respectively, of said sewn portion.

4. An in-line skate comprising:

a boot for receiving a skater's foot, said boot including a sole;

a frame secured to said sole, said frame carrying a plurality of linearly aligned rollers;

said boot further including a boot upper secured to said sole, said upper having:

a molded toe box secured to said sole at a toe end thereof, said toe box having walls including a forward wall, a top wall and side walls defining a toe box cavity sized to receive the toes of said skater's foot, said side walls and top walls terminating at a left wall edge, a right wall edge and a top wall edge;

said boot including a sewn portion including a heel, a right side wall and a left side wall with said heel and right and left side walls having a common bottom perimeter, said right and left side walls of said sewn portion secured to said right and left wall edges, respectively, and said bottom perimeter secured to said sole;

left and right side wall molded side panels secured to said left and right side walls, respectively, of said sewn portion, and said right and left panels and said toe box having opposing edges with means for providing sliding, overlapping positioning of said panels relative to said toe box.

5. An in-line skate according to claim 1 comprising airflow openings formed through said toe box.

* * * * *